US005364251A

United States Patent [19]

Simonsen

[11] Patent Number: 5,364,251

[45] Date of Patent: Nov. 15, 1994

[54] WORM PUMP FOR THICK MEDIA AND/OR MEDIA CONTAINING LUMPS, E.G. MEAT

[75] Inventor: Knud Simonsen, Slagelse, Denmark

[73] Assignee: Simo Industries A/S, Slagelse, Denmark

[21] Appl. No.: 61,035

[22] Filed: May 14, 1993

[30] Foreign Application Priority Data

May 14, 1992 [DK] Denmark ..... 0636/92

[51] Int. Cl.[5] ..... F04C 2/00; F04C 3/04; A22C 11/08

[52] U.S. Cl. ..... 418/220; 452/41

[58] Field of Search ..... 418/15, 195, 220, 225; 452/41

[56] References Cited

U.S. PATENT DOCUMENTS

| | | | |
|---|---|---|---|
| 1,306,572 | 6/1919 | Bartlett | 418/220 |
| 1,941,141 | 12/1933 | Roth | 418/220 |
| 2,577,361 | 12/1951 | Pool et al. | 418/220 |
| 2,837,762 | 6/1958 | Azzini et al. | 452/41 |
| 2,963,735 | 12/1960 | Gaudlitz | 452/41 |

FOREIGN PATENT DOCUMENTS

| | | | |
|---|---|---|---|
| 1169709 | 1/1959 | France . | |
| 3408967 | 9/1985 | Germany | 418/220 |
| 3712144 | 10/1988 | Germany . | |
| 824798 | 12/1959 | United Kingdom | 418/220 |

*Primary Examiner*—John J. Vrablik
*Attorney, Agent, or Firm*—Larson and Taylor

[57] ABSTRACT

Worm pump for thick media and/or media containing lumps, e.g., meat in pieces, of the kind comprising a tubular housing with an inlet and an outlet, a worm rotor rotatably supported in the housing, and a worm-gate assembly comprising a number of gate members adapted during the rotation of the worm to protrude into and follow the latter's convolutions and thus prevent the medium being pumped from following the rotation of the worm rotor. The worm-gate assembly comprises a number of loose gate members slidingly supported in an endless track of which a substantially rectilinear portion extends alongside and parallel to the worm rotor.

5 Claims, 1 Drawing Sheet

ΔI
II

WORM PUMP FOR THICK MEDIA AND/OR MEDIA CONTAINING LUMPS, E.G. MEAT

TECHNICAL FIELD

The present invention relates to a worm pump. More particularly, the invention relates to a worm pump which is suitable for thick media and/or media containing lumps, for example, meat in pieces.

BACKGROUND ART

Worm pumps of the kind referred to above have until now been provided with a worm gate member in the form of a circular, gear-wheel-like disk engaging the convolutions of the worm rotor in a manner similar to the engagement of the toothed wheel with the worm in a worm gear. The function of the worm gate member is to prevent the medium being pumped from rotating together with the worm rotor, which—of course—would result in no pumping effect being produced. If in such known pumps a worm rotor with constant external diameter is used, such a wheel-shaped worm gate member can obviously only come into full engagement with the convolutions in the worm rotor at a single location of the latter. The result of this is partly an incomplete blocking of the convolutions, partly a risk that lumps in the medium being pumped, e.g., large muscular chunks in a non-comminuted meat mass, can be jammed between the worm gate member and the convolutions of the worm rotor in the region, in which the peripheral edge of the worm gate member approaches said only location, at which the blockage is effective.

DISCLOSURE OF THE INVENTION

It is the object of the present invention to provide a worm pump of the kind referred to initially, that does not suffer from the disadvantages referred to, and this object is achieved with a worm pump, according to the present invention which includes a worm gate assembly having a number of loose gate members slidingly supported in an endless track, of which a substantial portion extends alongside and parallel to the rotor of the worm pump.

With this arrangement, the region of the worm rotor, at which the worm gate assembly engages with effective blockage, may be given any desired length, thus partly achieving an effective blockage, partly avoiding lumps or chunks being jammed in the manner mentioned, it only being necessary to introduce the medium to be pumped in a location, in which an effective blockage has already been formed.

Advantageous embodiments of the worm pump according to the invention, are explained in the following detailed portion of the present description, as are the effects thereof in so far as they are not self-evident.

BRIEF DESCRIPTION OF THE DRAWING

In the following detailed portion of the present description, the present invention will be explained in more detail with reference to the stuffing machine for meat mass shown on the drawing, said machine comprising an exemplary embodiment of a worm pump according to the invention, whereas

Figures 1, 2:
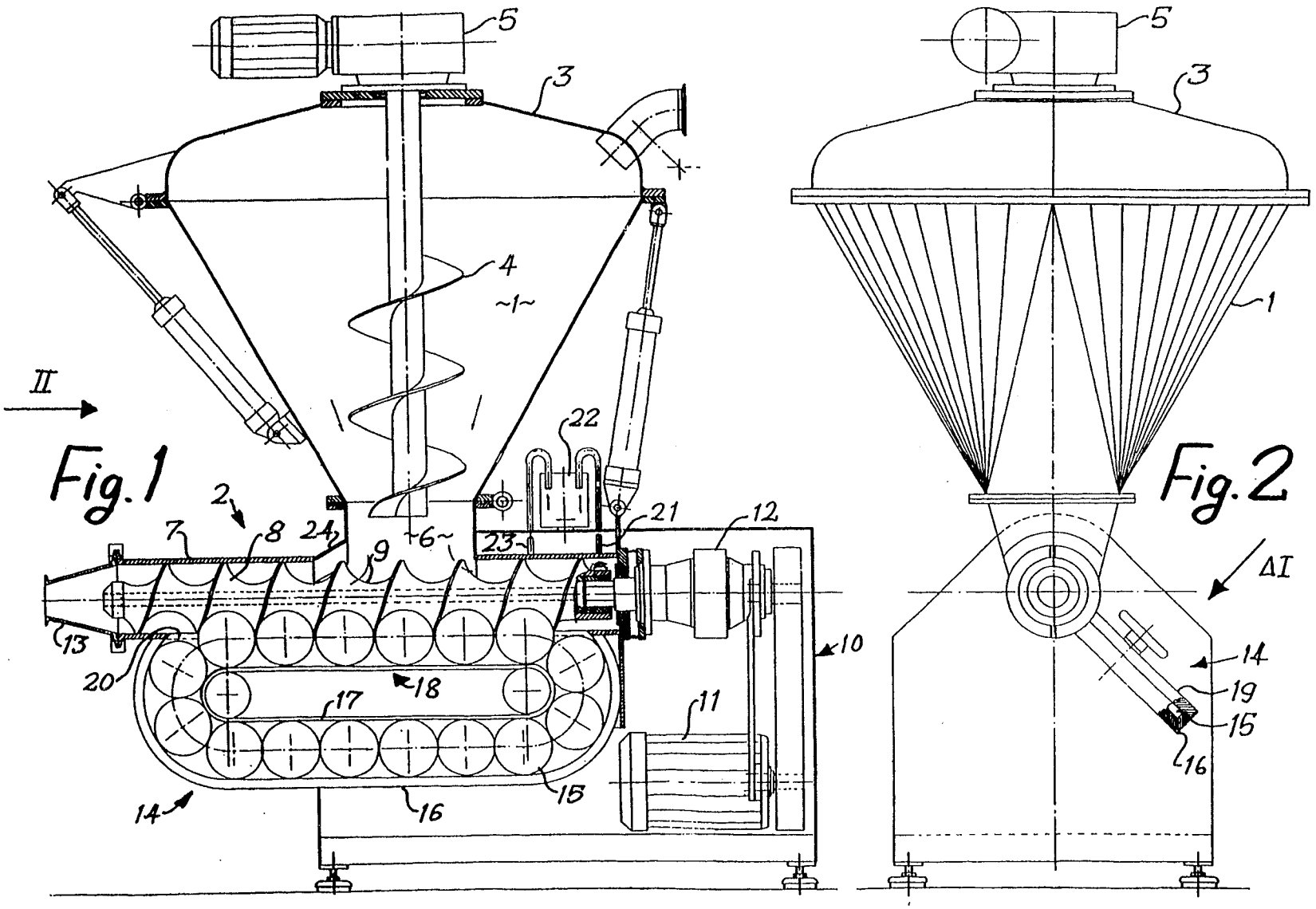
FIG. 1 shows the machine in side elevation and partly in section, the track housing for the gate members being shown as viewed in the direction of the arrow Δ I in FIG. 2.
FIG. 2 shows the machine as viewed from the outlet end, i.e. corresponding to viewing the machine in the direction of the arrow II in FIG. 1.

The stuffing machine shown in the drawing, designed for processing meat mass (not shown) or the like, consists in a manner known in principle of two main parts, viz.

a filling-in hopper 1, and a worm pump 2.

In a manner known per se, the hopper 1 is provided with a movable cover 3, in the closed position shown fitting closely to the hopper 1, so that the latter may be evacuated by means of known equipment (not shown), e.g. a vacuum pump. A supply worm 4 is adapted to rotate about a vertical axis, being supported and driven by a motor assembly 5. The reason for using the term "supply worm" is that it is adapted to supply the meat mass (not shown) being present in the hopper 1 to the worm pump 2, viz. through the latter's inlet 6.

The worm pump 2 consists of a stationary tubular housing 7, in which the pump's worm 8 is rotatably supported. As will be evident from FIG. 1, the convolutions 9 of the worm 8 are shaped like a channel having a generally semicircular shape as seen in a longitudinal sectional view through the worm 8. The worm 8 is adapted to be driven counter-clockwise as viewed in FIG. 2 by means of a drive assembly 10 consisting of a motor 11 driving a gear box 12, e.g. a planetary gear box, preferably in such a manner that the worm 8 may be driven with different speeds from 0 to 100 rpm. This is based on the worm 8 having a diameter of the order of magnitude 20–30 cm.

During the rotational movement of the worm 8, the meat mass having been introduced through the inlet 6 by means of the supply worm 4 will be conveyed to an outlet 13. This conveying will, of course, depend on the meat mass not rotating together with the worm 8, as if so, there would not occur any cooperation between the meat mass and the convolutions 9 in the manner known e.g. from small meat mincers, in which the part corresponding to the tubular housing 7 is shaped with longitudinal grooves on the inside.

To make it quite certain that the meat mass does not rotate together with the worm 8, the worm pump 2 is additionally provided with a worm gate assembly 14 consisting of a number—in the example shown sixteen—gate members in the form of unconnected disks 15 being guided in an endless track in an elongated track housing 16, viz. between the latter's outer wall and an internal guide 17 situated at a substantially constant distance from the outer wall, with the exception of a rectilinear track portion 18, at which the track housing 16 is in open communication with the inside of the tubular housing 7, the internal guide 17 on this side extending parallel to the worm 8.

As will be evident from FIG. 2, the track housing 16 is in the form of a flat tray or pan, closed in a fluid-tight manner by a removable cover 19, so that the endless track, in which the disks 15 are guided, is also delimited by the bottom of the track housing 16 and by the cover 19.

The inside of the tubular housing 7 and the inside of the track housing 16 communicate with each other through a slot 20, through which each 15 can protrude into the housing 7 and engage the convolutions 9 in the worm 8. Since the disks 15 are constrained by the housing 16 and the latter's cover 19 to move in a plane at least being parallel with the axis of the worm 8, these disks will, when the worm rotates, be moved towards the outlet 13, and in all parts of this movement between the point of initial engagement with the worm 8 and the point of disengagement, they provide a highly effective obstruction for meat mass, that could otherwise tend to follow the rotation of the worm 8 and hence not be moved towards the outlet 13. Thus, during the rotation of the worm 8, the disks 15 will be constrained by the endless track in the housing 16 to move as if they were parts of an endless chain, even though they are not connected to each other in any manner whatsoever.

As will be evident from the present description and the drawing, the gate members in the worm gate assembly 14 are constituted by a number of flat, circular discs 15. It does, however, lie within the scope of the present invention to use gate members of a different shape, provided of course, that they engage in a fluid-tight manner with the convolutions 9 in the worm 8 and can move together with these in the manner described. Thus, it could be possible to use ball-shaped or double-cone-shaped gate members, the track housings corresponding to the track housing 16 then, of course, to be shaped in such a manner that they can guide such gate members in the same manner as the track housing 16 guides the disks 15.

As will be evident from FIG. 1, the end of the tubular housing 7 at the greatest distance from the outlet 13 is provided with evacuation means in the form of a vacuum connection 21, being connected to a vacuum pump (not shown) or the like through a "vacuum trap" 22 and a vacuum conduit 23. When the vacuum connection 21 in this manner is situated in a location, at which the convolutions 9 and the disks 15 have not yet engaged the meat mass being supplied through the inlet 6, the air may be evacuated from the convolutions 9 before the latter—relatively speaking—reach the meat mass, the latter for this reason filling the convolutions completely without forming air pockets.

Since the worm pump 2, due to the effect of the disks 15, functions as a volumetric pump, and the formation of air pockets is prevented by means of the vacuum connection 21, the volume of meat mass being conveyed per revolution will be substantially constant, so that the number of revolutions of the worm 8 can be taken as a measure of the volume of the meat mass being ejected through the outlet 13.

As will also be evident from FIG. 1, the disks 15 are moved into full engagement with the convulutions 9 on the worm 8 at an appreciable distance from the location, viz. at the inlet 6, where the meat mass first comes into contact with the worm 8. This arrangement prevents lumps of meat from getting jammed between one or more of the disks 15 and the convolutions 19, before the disks have been moved into full engagement with the convolutions 9, and thus, the risk of shearing of meat lumps at this location is avoided. At the transition between the inlet 6 and the part of the tubular housing 7 situated downstream from the inlet there is, however, a certain risk that lumps of meat can get jammed between the inside of the tubular housing 7 and the ridge of the convolutions 9 on the worm 8, and in order to minimize this risk an inclined wall 24 has been placed at this transition. Due to the inherent elastic properties of the lumps of meat, the majority of such lumps possibly getting jammed between the ridge of the convolutions 9 and the inclined wall 24 will slip forwards or backwards and hence avoid being sheared between the housing 7 and the ridge of the convolutions.

The health authorities of most countries require machines for processing meat to be opened, cleaned and disinfected completely with short intervals, e.g. at least once a day. With regard to the worm gate assembly 14, this requirement can easily be met by opening the cover 19 and removing the disks 15, after which it is easy to clean both the inside of the housing 16 including the lower side of the cover 19, and the disks 15 proper. In addition to the advantage with regard to a long-lasting and efficient gating engagement with the worm 8, achieved by using loose gate members, e.g. the disks 15 as shown, a substantial economic advantage is achieved, partly because such loose gate members are considerably simpler and cheaper to produce than the previously used toothed disks, partly because the loose gate members can be replaced singly, if one of them were to have been damaged.

As will be evident from FIG. 2, the track housing 16 is shaped and oriented in such a manner, that the disks 15 do not fall out upon removal of the cover 19. This is especially an advantage when the disks are to be put back in place after the cleaning, as it would otherwise be necessary to use special means for holding them in place until the track housing had been closed.

It is not shown or described herein, how the stuffing machine shown is provided with the requisite gaskets, bearings, fittings, etc. so as to be able to function as intended. Persons skilled in this art will, however, know how to design, shape, and place such means.

| LIST OF PARTS | |
|---|---|
| 1 | hopper |
| 2 | worm pump |
| 3 | cover |
| 4 | supply worm |
| 5 | motor assembly |
| 6 | inlet |
| 7 | tubular housing |
| 8 | worm |
| 9 | convolutions |
| 10 | drive assembly |
| 11 | motor |
| 12 | gear box |
| 13 | outlet |
| 14 | worm gate assembly |
| 15 | disk/gate member |
| 16 | track housing |
| 17 | internal guide |
| 18 | rectilinear track portion |
| 19 | cover |
| 20 | slot |
| 21 | vacuum connection |
| 22 | "vacuum trap" |
| 23 | vacuum conduit |
| 24 | inclined wall |

I claim:

1. A worm pump comprising:

a worm pump housing having a generally rotationally symmetrical worm chamber with an inlet and an outlet;

a worm rotor rotably supported in the worm chamber, said worm rotor having convolutions for pumping material from said inlet to said outlet; and means for blocking said convolutions, said convolution blocking means comprising:

a track housing situated laterally of the worm chamber and containing at least part of an endless track limited inwardly by a guide member surrounded by the track and outwardly partly by an inside wall of the track housing and partly by the worm rotor;

a plurality of loose gate members supported for movement along said endless track, the loose gate members which are located in the part of the endless track not limited by the inside wall of the track housing engaging sealingly with the convolutions of the worm rotor, at least part of the width of said endless track extending outside of the worm pump housing to enable said gate members to sealingly engage the convolutions of the worm rotor;

said track housing further comprising a tray-shaped or pan-shaped lower part permanently secured to said worm-pump housing and to which said guide member is shaped or secured, respectively, and a cover securable to said lower part close said lower part substantially fluid-tight against the surroundings;

whereby the track housing is adapted to be opened, by opening said cover, such that the gate members may be removed from and inserted into the endless track transversely of the operational direction of the endless track.

2. A worm pump according to claim 1 wherein the rotational axis of the worm rotor extends in a non-vertical manner and wherein the track housing is inclined at an angle downwardly away from the worm housing, whereby the gate members will not fall out of the housing when said lower part is lowered by removal of said cover.

3. Pump according to claim 1, wherein the gate members and the convolutions of the worm rotor are mutually adapted in such a manner that the gate members present in said part of said track portion and being moved in engagement with the convolutions of the worm rotor, are in substantially fluid-tight contact with the bottom and sides of the convolutions.

4. Pump according to claim 3, wherein the gate members are rotationally symmetric about axes extending transversely to their direction of movement along the worm rotor, the latter's convolutions correspondingly having a circular-arc-shaped sectional shape parallel to the axis of the worm rotor.

5. Pump according to claim 2, wherein the gate members comprise circular disks.

* * * * *